United States Patent [19]

Grubert

[11] Patent Number: 5,027,899

[45] Date of Patent: Jul. 2, 1991

[54] METHOD OF GRAVEL PACKING A WELL

[75] Inventor: Duane Grubert, Anchorage, Ak.

[73] Assignee: Union Oil Company of California, Los Angeles, Calif.

[21] Appl. No.: 546,050

[22] Filed: Jun. 28, 1990

[51] Int. Cl.[5] ..... E21B 43/04; E21B 43/267

[52] U.S. Cl. ..... 166/278; 166/280; 166/297

[58] Field of Search ..... 166/276, 278, 280, 281, 166/297

[56] References Cited

U.S. PATENT DOCUMENTS

| | | | |
|---|---|---|---|
| 2,167,190 | 7/1939 | Vietti | 166/278 |
| 2,356,769 | 8/1944 | Layne | 166/278 |
| 2,814,347 | 11/1957 | MacKnight | 166/278 |
| 2,955,653 | 10/1960 | Cain | 166/278 |
| 3,710,862 | 1/1973 | Young et al. | 166/278 |
| 4,378,845 | 4/1983 | Medlin et al. | 166/278 X |
| 4,549,608 | 10/1985 | Stowe et al. | 166/278 X |
| 4,645,005 | 2/1987 | Ferguson | 166/278 |
| 4,685,519 | 8/1987 | Stowe et al. | 166/278 |
| 4,817,717 | 4/1989 | Jennings, Jr. et al. | 166/278 |

*Primary Examiner*—George A. Suchfield

*Attorney, Agent, or Firm*—Clark E. DeLarvin; Gregory F. Wirzbicki

[57] ABSTRACT

A well, penetrating a subterranean fluid-producing formation, is effectively gravel packed by a method comprising two sequential steps. In the first step, a slurry of gravel and carrier fluid is introduced into the formation at a pressure substantially in excess of the formation fracture pressure. In the second step, a slurry of gravel and carrier fluid is introduced into the formation at a pressure below the formation fracture pressure. Wells so treated exhibit enchanced rates of production for longer periods of time than would be obtained with conventional gravel packing.

29 Claims, No Drawings

METHOD OF GRAVEL PACKING A WELL

FIELD OF THE INVENTION

This invention relates to a method of gravel packing a well. More particularly, it relates to a two-step method in which the first step is accomplished at a high hydrostatic pressure, and the second step utilizes a substantially lower hydrostatic pressure.

BACKGROUND OF THE INVENTION

When a well penetrates a subterranean fluid-producing formation, the formation penetrated may have one of several different physical characteristics. When it is highly permeable and of an unconsolidated nature, the produced fluids can be expected to contain some particulate matter, generally referred to as sand. It is, of course, undesirable to produce such particulate matter with the production fluids because of abrasion of production tubing, valves and other equipment used. In addition, the sand could produce flow restrictions or even plugging of the fluid passageways. It is therefore necessary in such instances to avoid production of such sand and other particulate matter with the fluids. In other instances, the formation may have a low permeability which would result in low production levels. In such instances, it is necessary to take measures to increase the flow of fluid from the formation.

The co-production of fluid and sand from the formation can be reduced by "gravel packing" the well during completion operations. Gravel packing includes providing on the production conduit or tubular work string a device, including a slotted or ported cylindrical shaped member, which prevents the passage therethrough and into the interior of the conduit of solid particles exceeding a predetermined size. Such devices are incorporated into equipment and methods wherein gravel packing is introduced into an annular area between the production conduit or work string and the casing of the well, with the gravel being deposited longitudinally and exteriorly of the slotted or ported cylindrical member.

Gravel packing of wells, extending into loosely consolidated permeable formations, also has been accomplished utilizing a "pre-pack" device. The pre-pack device comprises gravel, glass beads, bauxite or other solid particulates disposed between an outer member and an inner ported member. Typically, the outer member is a stainless steel wire mesh screen. The device is affixed to the end of a production conduit and lowered into the well adjacent a production zone to prevent particulate matter, produced with the production fluids, from entering the interior of the conduit. Such prepacks may be used alone or in conjunction with apparatus and method wherein the well bore also is gravel packed.

When the producing formation is of a more consolidated, less permeable nature, a different problem is presented. The low permeability results in low production levels of the fluid of interest. To enhance the flow of fluids from such a formation, methods have been developed for fracturing the formation to provide passageways for the flow of fluids therethrough. A typical fracturing method comprises pumping a fracturing fluid down a well bore and into the formation. The fluid is introduced at a pressure above that at which the formation will fracture. This forms one or more channels (i.e., failures or fractures) in the formation through which fluids can flow. In most instances, a proppant (e.g., sand) is included with the fracturing fluid to keep the fracture open after the formation fracturing pressure is reduced.

Another method of increasing the productivity from more consolidated formations having a low permeability is to use an explosive charge. A disadvantage of this method, however, is the heat and explosive nature of the charge can damage the casing, cement, or formation in areas where fractures are not wanted. In addition, since the fractures created are not propped open, they may close quickly after the pressure decreases.

Frequently the foregoing methods provide only a short-term effect, and the daily production dwindles over a period of months to a level at which production is no longer economically practical. Accordingly, while the foregoing methods have provided some benefits in obtaining production from difficult formations, there still is need of further improvements. More particularly, there is a need for a method of enhancing production and controlling sand, which method should have a sustained lasting effect.

SUMMARY OF THE INVENTION

The present invention provides a method of gravel packing a well bore which results in both enhanced production and uniform production rates over substantially greater periods of time than would be obtained with conventional gravel packing methods. Additionally, the tightness and coverage of the gravel pack is greatly improved. The method is accomplished in two steps. In the first step, an initial gravel-containing carrier fluid is introduced into a well bore annulus and into a subterranean formation at a pressure sufficient to cause fracturing of the formation. In the second step, a gravel-containing carrier fluid is introduced into the well bore annulus at a pressure below that at which fracturing of the formation will occur. A sufficient amount of gravel introduced to form a gravel pack in the well bore annulus adjacent the formation. In each step, the gravel-containing carrier fluid may be the same or different. Generally it is preferred to use the same carrier fluid with a gravel loading in the range of from about 4 to 16 pounds of gravel per gallon of carrier fluid.

In accordance with a particularly preferred embodiment, a well casing in the well bore is first perforated to provide a plurality of perforations adjacent to the formation of interest. The number and size of the perforations are selected to ensure an adequate flow of gravel and carrier fluid through the perforations to effect the desired fracturing and gravel packing.

DETAILED DESCRIPTION OF A PREFERRED EMBODIMENT

The present invention is applicable to any fluid-bearing, subterranean formation, for example, oil, gas and water bearing formations. For convenience, it will be described with respect to an oil bearing formation. The invention will be illustrated by detailed description of a preferred embodiment thereof. It will be understood by those skilled in the art that variations and modifications of this preferred method may be effected without departing from the scope of the present invention.

As used in this specification, the term "gravel" shall be understood to include any particulate material such as sand, bauxite, gravel, ceramic (natural or artificial)

beads, or other material used in gravel packing operations. In a gravel packing treatment, gravel is introduced into the well bore and passes through perforations in a well casing. In accordance with the present method, the gravel fractures the formation, supports the fractures in the formation, prevents caving in of loose material against the well casing, and serves to restrain sand or other fine particulate materials from entering into the well.

The size of the gravel particles is selected such that the interstitial space between the particles effectively filters small formation particles without unduly restricting the flow of well fluids into the bore. Generally, a gravel having a size of less than 20 mesh down to about 100 mesh (U.S. Standard Sieve Series) is satisfactory, with 20 to 40 mesh sand being preferred.

A carrier fluid, having viscosity sufficient to maintain the gravel in suspension while the slurry is being pumped down the hole, is also employed. The carrier fluid may be either an aqueous-base or an oil-base liquid. Suitable aqueous-base liquids comprise water and brine. Suitable oil-base liquids include hydrocarbon oils and oil-base drilling fluids. To obtain the requisite viscosity, thickening or gelling agents may be added to the carrier fluid. With water-base carrier fluids, thickening is accomplished by the addition of natural or synthetic gums, such as guar gum, polysaacharides such as sugar, polymers such as polyacrylamide, bipolymers such as xanthan, and cellulose derivatives. A preferred thickener is a cellulose derivative such as hydroxyethylcellulose (HEC) and the like. A typical hydroxyethylcellulose carrier fluid may comprise up to 80 pounds of HEC or more per thousand gallons of aqueous fluid. The amount of thickener required will vary as a function of the sand loading per gallon of carrier fluid and to a lesser extent the rate at which it is being pumped into the formation.

The method of the present invention will now be described with reference to the completion of a new well. After a well bore has been drilled through at least one fluid producing formation, for example, an oil-bearing formation, a well casing is lowered into the bore. A typical well casing is comprised of a 9½ inch steel pipe. A tube is conveyed down the casing. Attached to the lower end of the tube are shaped charges for perforating the casing adjacent the fluid producing formations of interest. Typically, packers are placed in the casing to isolate the area to be perforated from the rest of the well bore.

The shaped charges are selected to provide from about 4 to 12 and preferably 6 to 10 perforations per linear foot of casing. The charges also are selected such that the perforations produced will have an approximate diameter of at least ¼ of an inch and preferably from about ¼ to 1 inch, with a size in the range of from about ⅜ to ¾ inch being most preferred. Preferably, the charges are located in a spiral about the tubing such that linearly adjacent charges (and resulting perforations) are angularly displaced from one another by from 45° to 180° and preferably about 60° to 120°.

Just prior to detonating the charges, it is preferred that the pressure in the casing, where the charges are located, be less than that of the formation pressure. When the charges are ignited, there will be a momentary high pressure pulse as the perforations are formed in the casing. This pressure burst will also cause adjacent formation damage. The sudden decay in pressure following the explosion will be followed by a reverse fluid flow as a result of a higher pressure in the formation. This sudden surge of pressure into the well bore will clean the perforations of any debris which might otherwise restrict fluid flow. Typically the well bore pressure will be from 200 to 1000 psig less than the formation pressure. After removal of the tubing, the well bore is now ready for gravel packing in accordance with the present method. Obviously, perforation by other methods also can be utilized.

In accordance with the present invention, the first step comprises fracturing the fluid-producing formation of interest. A slurry of sand in a carrier fluid is pumped down the well bore and out through the perforations at a pressure above the fracture gradient of the formation. A typical sand loading utilized is from about 5 to 20, generally from 6 to 16, and preferably 8 to 12 pounds of gravel per gallon of carrier fluid. The pressure utilized will vary, of course, depending upon the particular formation structure. A well head pressure of from 1000 up to 10,000 psig or more may be required. Preferably, the pressure will be from 1 to about 2½ times the calculated fracture pressure to ensure adequate fracturing of the formation. This determination of required fracture pressure is readily made by one skilled in the art, based on samples taken from the formation during drilling operations.

In contrast to the prior art liquid fracturing methods, the present invention produces a relatively short fracture in terms of area. More particularly, heretofore, it was common practice to attempt to produce fractures in the formation which extended out through at least 30 and preferably 100 percent of the drainage radius of the well bore. The present invention utilizes a short radius fracture length of from about 5 to 25 percent of the well bore drainage radius. The drainage radius is readily determined from samples of the formation and size of the reservoir. The length of the fractures will be a function of the volume of slurry introduced into the formation. Typically, the fracturing step is controlled to provide theoretical fracture lengths of from about 20 to 200 feet and preferably 50 to 100 feet. Another novel aspect of this first step is that the sand loadings in the carrier fluid are maintained substantially constant and high throughout, as opposed to the prior art which generally suggested gradually increasing the sand loading. The desired extent of fracturing typically will be accomplished in a matter of minutes; thus, the level of sand loading in the carrier fluid must be obtained rapidly. A typical pumping (fracturing) time is less than 60 minutes and is generally from 10 to 30 minutes.

The second step of the present invention comprises the introduction of sand and carrier fluid into the formation at a pressure below that at which fracturing of the formation will occur. During this step the slurry is generally pumped at a well head pressure of less than 1000 psig. Typical pressures are in the range of 100 to 500 psig. Generally, the interior portion of the well bore adjacent the formation of interest is isolated from the rest of the well bore by packers as previously described. A tubular member is introduced into the well bore and terminates adjacent its lower end in a wire mesh which filters fluid being returned to the well head. The tubular member includes means for discharging the slurry of sand and carrier fluid into an annular space defined by the tubular member and an inner surface of the well casing. Preferably, the slurry has substantially the same composition as that used in the first step.

The slurry is pumped through the annular space and out through the perforations in the casing. The gravel deposits in the annular space, perforations and in a portion of the formation immediately surrounding the exterior of the well casing. A substantial portion of the carrier fluid is filtered passes through the wire mesh into the tubular member and is returned to the surface. The remainder of the carrier fluid enters the formation through the perforations in the casing. The fluid entering the formation is advantageous as it enhances the tightness of the gravel pack and aids in gravel packing those portions of the casing where no perforations are present. The first step, which produces fractures in the formation, permits the fluid to flow more freely into the formation. This in turn, facilitates the subsequent gravel packing and results in enhanced control (prevention) of the entry of particulates into the well casing. The pumping continues until ideally the annular space and all of the perforations are filled with gravel. A substantial amount of gravel also will be located peripherally about the exterior of the casing. The foregoing results may be accomplished utilizing theoretical calculations based on the amount of gravel introduced, or the time and rate at which it was introduced. Alternatively, it will be indicated by an increase in pumping pressure at the surface.

The selection of the wire mesh is not critical and may be any of those utilized for gravel packing operations as practiced heretofore. The wire mesh means typically will have fluid flow openings sufficiently large to permit fluid, which has been filtered through the gravel pack, to pass inwardly into the tubular member, but also will be sized sufficiently small to prevent the gravel from passing inwardly therethrough and into the tubular member.

Three wells have recently been completed, off shore Alaska, to prove the efficacy of the present invention. They have not yet been in production a sufficient length of time to conclusively establish sustained production rates. Nonetheless, they are producing at the predicted higher rates and have shown no indication of a significant decline.

While the invention has been described in the more limited aspect of a preferred embodiment thereof, other embodiments have been suggested and still others will occur to those skilled in the art. For example, while the invention has been described with respect to the completion of a new well, it will be apparent it also is applicable to an existing well. The foregoing and other aspects of the invention are discussed in a paper presented at a symposium sponsored by the Society of Petroleum Engineers held in Lafayette, La. during Feb. 22–23 of 1990. The contents of that paper, SPE 19401, are incorporated herein by reference. It is intended that all such aspects, variations and embodiments be included within the scope of the invention as defined by the appended claims.

What is claimed is:

1. A method of gravel packing a well bore annulus having a drainage radius, including perforations extending into a producing formation, comprising the sequential steps of:

(a) introducing a slurry of gravel in a carrier fluid into said annulus through the perforations and into said formation, said slurry being introduced at a pressure in excess of the formation fracturing pressure and in an amount to produce fractures extending outwardly a length of from 5 to 25 percent of the well bore drainage radius, and (b) introducing another slurry of gravel in a carrier fluid into said annulus and through the perforations, said slurry being introduced at a pressure below the formation fracturing pressure.

2. The method of claim 1 wherein a step (a) the slurry comprises from 5 to 20 pounds of gravel per gallon of carrier fluid.

3. The method of claim 1 wherein in step (b) the slurry comprises from 5 to 20 pounds of gravel per gallon of carrier fluid.

4. The method of claim 1 wherein said slurry pressure in step (a) is in the range of from 1000 to 10,000 psig.

5. The method of claim 1 wherein in step (b) the slurry pressure is less than 1000 psig.

6. The method of claim 1 wherein in step (a) said slurry is introduced for a time sufficient to produce fractures extending radially outward from the well bore a distance of from 20 200 feet and the time is from 10 to 30 minutes.

7. The method of claim 6 wherein the fractures extend radially outward from the well bore a distance of 50 to 100 feet.

8. The method of claim 1 wherein in steps (a) and (b) the slurry comprises from about 8 to 12 pounds of sand per gallon of carrier fluid.

9. The method of claim 1 wherein in step (b) the slurry is introduced at a pressure of from about 100 to 500 psig.

10. A method of packing a well, said well including a casing in a well bore having a drainage radius and extending into a fluid-producing formation and having perforations therethrough adjacent the formation, said method comprising the sequential steps of:

(a) introducing a first slurry of a gravel-containing carrier fluid into said well, through said perforations and into said formation, said carrier fluid being introduced at a pressure of from 1 to 2½ times the pressure required to fracture the formation and for a time sufficient to produce fractures in the formation extending through about 5 to 25 percent of the well bore drainage radius; and (b) introducing a second slurry of a gravel-containing carrier fluid into said casing, through said perforations and into a portion of said formation adjacent an exterior of said casing, said second slurry being introduced at a pressure less than that which would fracture the formation, and recovering a substantial, filtered portion of the carrier fluid from said casing.

11. The method of claim 10 wherein in steps (a) and (b) the slurry comprises from about 8 to 12 pounds of sand per gallon of carrier fluid.

12. The method of claim 10 wherein the fractures extend radially outward from the well bore a distance within the range of 50 to 100 feet and the time is from 10 to 30 minutes.

13. The method of claim 10 wherein in step (b) the slurry is introduced at a pressure of from about 100 to 500 psig.

14. The method of claim 10 wherein in step (a) the slurry comprises from 5 to 20 pounds of gravel per gallon of carrier fluid.

15. The method of claim 10 wherein in step (b) the slurry comprises from 5 to 20 pounds of gravel per gallon of carrier fluid.

16. The method of claim 10 wherein said slurry pressure in step (a) is in the range of from 2000 to 10,000 psig.

17. The method of claim 10 wherein in step (b) the slurry pressure is less than 1000 psig.

18. The method of claim 10 wherein in step (a) said slurry is introduced for a time sufficient to produce fractures extending radially outward from the well bore a distance of from at least 20 to less than about 200 feet.

19. The method of claim 10 wherein said perforations have a diameter of from ¼ to 1 inch.

20. A method of completing a well, said well including a casing extending through a well bore into a fluid-producing formation, the well bore having a drainage radius, said method comprising the sequential steps of:

(a) forming from 4 to 12 perforations per linear foot through a portion of said casing adjacent said producing formation, said perforations having a diameter of from ¼ to 1 inch;

(b) introducing a slurry, comprising gravel and a carrier fluid, into said formation at a pressure above that which will fracture the formation and for a time of less than 60 minutes to cause fractures in said formation extending a length of about 5 to 25 percent of the well bore drainage radius; and (c) introducing a slurry comprising gravel and carrier fluid into an annular space defined by said casing and a tubular member disposed therein, said slurry being introduced at a pressure below that at which fracturing of the formation will occur, recovering a filtered carrier fluid from said annular space and passing it upwardly through said tubular member, and continuing the flow of slurry until said annular space, perforations and a volume adjacent an outer surface of the casing are packed with gravel.

21. The method of claim 20 wherein said perforations have a diameter of from ⅜ to ¾ of an inch.

22. The method of claim 21 wherein in step (a) there are provided from 8 to 12 perforations per linear foot.

23. The method of claim 22 wherein linearly adjacent perforations are angularly disposed from one another by from 90° to 180°.

24. The method of claim 23 wherein in steps (b) and (c) the slurry comprises from about 8 to 12 pounds of sand per gallon of carrier fluid.

25. The method of claim 24 wherein the fractures extend radially outward from the well bore a distance within the range of 50 to 100 feet.

26. The method of claim 25 wherein in step (b) the slurry is introduced at a pressure of from about 100 to 500 psig.

27. The method of claim 20 wherein in steps (b) and (c) the slurry comprises from about 8 to 12 pounds of sand per gallon of carrier fluid and the carrier fluid includes a thickener.

28. The method of claim 20 wherein the fractures extend radially outward from the well bore a distance of at least 50 to less than about 100 feet.

29. The method of claim 20 wherein in step (b) the slurry is introduced at a pressure of from about 100 to 500 psig.

* * * * *

UNITED STATES PATENT AND TRADEMARK OFFICE

CERTIFICATE OF CORRECTION

PATENT NO. : 5,027,899

DATED : July 2, 1991

INVENTOR(S) : Duane Grubert

It is certified that error appears in the above-identified patent and that said Letters Patent is hereby corrected as shown below:

Column 6, claim 6, line 18, after "20" insert -- to --.

Signed and Sealed this

Eighth Day of December, 1992

*Attest:*

DOUGLAS B. COMER

*Attesting Officer*

*Acting Commissioner of Patents and Trademarks*